United States Patent [19]

Shell

[11] Patent Number: 4,856,961

[45] Date of Patent: Aug. 15, 1989

[54] LARGE CAPACITY WING LOADER AND UNLOADER APPARATUS FOR CARGO SHIPS

[76] Inventor: Melvin E. Shell, P.O. Box 1121, Stephenville, Tex. 76401

[21] Appl. No.: 32,774

[22] Filed: Mar. 31, 1987

[51] Int. Cl.[4] ..... B63B 27/16; B65G 67/60

[52] U.S. Cl. ..... 414/749; 414/137.1; 414/141.7; 414/497; 414/661; 414/794.3

[58] Field of Search ..... 414/85, 140, 280, 497, 414/661, 749, 659, 137.1, 141.7, 277, 794.3

[56] References Cited

U.S. PATENT DOCUMENTS

| | | | |
|---|---|---|---|
| 3,820,667 | 6/1974 | Critchlow et al. | 414/497 X |
| 3,876,097 | 4/1975 | Svenson et al. | 414/137.1 X |
| 3,954,190 | 5/1976 | Howard et al. | 414/85 X |
| 4,674,949 | 6/1987 | Kroczynski | 414/750 |

FOREIGN PATENT DOCUMENTS

| | | | |
|---|---|---|---|
| 161733 | 12/1980 | Japan | 414/140 |
| 151194 | 8/1985 | Japan | 414/140 |
| 163088 | 7/1986 | Japan | 414/140 |
| 196887 | 9/1986 | Japan | 414/140 |

*Primary Examiner*—Robert J. Spar
*Assistant Examiner*—Janice Krizek
*Attorney, Agent, or Firm*—Hubbard, Thurman, Turner & Tucker

[57] ABSTRACT

Portable cargo loading apparatus capable of being placed into the hold of a ship for loading and unloading cargo respectively to and from the wing areas of the hold. Comprising the apparatus is a loading section formed of three large area relatively slidable trays arranged in a nesting relation capable of being power extended and retracted in a controlled operating sequence. During tray extension, cargo which has for example been delivered by a dockside crane directly into the uppermost tray is relocated by the apparatus from the delivery location for placement into a paired loading site within the wing. After loading of a localized wing site is completed, a transport section is operable to enable incremental lateral displacement of the loading section to a new paired location relatively juxtaposed to the wing site in which loading was just completed. Forming the transport section is a pair of spaced apart transversely extending and relatively displaceable beams of length at least twice the width of the loading section. An adjustment at each distal end of the beams enables the loading section to be elevated and laterally displaced along the beams to a successively new loading site. A power section including an electrical generator unit, pumps and controls enables the entire apparatus to be operatively self sufficient.

15 Claims, 4 Drawing Sheets

LARGE CAPACITY WING LOADER AND UNLOADER APPARATUS FOR CARGO SHIPS

TECHNICAL FIELD

The field of art to which the invention pertains comprises the art of material handling of the non gravity type.

BACKGROUND OF THE INVENTION

Over the years many different devices and methods have been used in loading cargo into the holds of deep water vessels and other haulage vehicles. Conveyor belts and pipes are used for particulate and fluid matter. Loads consisting of larger discrete objects are often handled by means of large portable containers. Food products such as rice are usually bagged and loaded in pallet sized stacks. Whatever arrangement is utilized for delivering the cargo from dockside or deckside through the cargo hatch to within the hold, the problem remains of finally dispensing the delivered cargo into their assigned locations in the wings of the hold. Typically, the crane utilized for delivering the cargo to a central location beneath the hatch is unable or unsuitable for appropriate removal of the cargo from the hatch area into the wing areas.

Typically, a large proportion of cargo space within a deep water vessel is located in the wing areas. Commonly, stevedores in the cargo hold must manually remove the cargo units from the delivery location and utilize mobile equipment for transporting the removed units to a remote location under the wing. With the limited load capacities of the mobile carriers such as fork lifts, frequent trips are required to complete any sizeable loading. Moreover, fork lifts are unsuitable for handling bag type cargo. Furthermore, they are characterized by limited stacking height capabilities frequently requiring manual labor to fill the remaining volume. Alternatively, the otherwise available cargo volume goes unused. In the process of stacking the cargo units in their assigned locations in the hold, the cargo units are usually handled individually or remain on a space-consuming pallet. Such manual handling has been recognized as time consuming and labor intensive amounting to a significant cost factor in the shipping expense of the goods that are ultimately passed on to the end user of the products which the cargo represents.

There has therefore been a long felt need to improve the disposition of delivered cargo from the delivery site location in the ship's hold to the final location within the wings of the hold selected for transport. Portable cargo loading equipment for fulfilling that purpose is disclosed in my co-pending application Ser. No. 830,235 filed Feb. 14, 1986, now abandoned. While functioning well for the intended purpose the equipment disclosed therein is characterized by a limited loading capacity on the order of about 2–3 metric tons per loading cycle depending on the size of the equipment selected. It has recently been recognized that much higher loading capacities on the order of ten metric tons per loading cycle and above would be highly cost effective and therefore desirable for many of the larger ocean going ships currently utilized. However, not only must such apparatus be characterized by the higher loading capacities, but it must be portable for hold placement and retrieval. Furthermore, it should preferably be self sufficient for both cargo placement and incremental self displacement for loading successive sites after loading of a selected site has been completed. Despite recognition of the problem, apparatus suitable for the larger capacities in satisfaction of the above has previously been unknown.

SUMMARY OF THE INVENTION

The invention relates to wing loader apparatus for cargo loading of cargo ships. More specifically, the invention relates to such cargo loading apparatus having significantly greater load handling capacity than heretofore so as to further reduce the labor intensity previously associated with the cargo loading of large ships. This is achieved in accordance with the invention by apparatus that is relatively portable for placement and retrieval within the ship's hold by means of a deckside or a dockside crane. Yet when placed in the hold in loading relation with the wing area selected for loading, the apparatus not only can place cargo centrally received wtihin the hold into the designated wing areas, but is capable of incremental lateral self displacement for positioning relative to the next successive wing site to be loaded.

To enable the foregoing to be achieved, the apparatus is comprised of three separate sections including a first section for cargo loading and unloading, a second section for effecting lateral self displacement and a third section including a power source, pumps, valves, controls, etc., for controllably operating the first and second sections. Forming the first section are a plurality of stacked and nested large area trays. The lowermost of the trays is stationary whereas the middle and upper trays can be selectively extended and retracted by a drive motor and hydraulic cylinders respectively for placement and push off of a delivered cargo at the wing storage site in the vessel for shipment.

The second section is comprised of horizontal elongated beams parallel and spaced apart and supported on upright columns extending transversely to the first section. The length of the beams are approximately twice the width of the first section and at each distal end support a downwardly depending hydraulic cylinder. When the hydraulic cylinders are retracted upward the entire main frame of the apparatus including the first and third sections rests on flooring of the hold. When the hydraulic cylinders are extended to and against the flooring, the main frame being intermediate the cylinders is caused to be elevated above the flooring. Via drive means actuated with the main frame in the latter relation, the main frame is laterally displaced incrementally along the beams relative to a successive location at which cargo is to be placed into the wings of the hold. On reaching the successive location, the hydraulic cylinders are retracted lowering the main frame onto the floor. The beams are then free to be transversely extended relative to the main frame preparatory for the next incremental displacement thereof.

The third section provides the power equipment to render the apparatus self sufficient and includes a power generator which may be omitted where sufficient local power is otherwise available.

It is therefore a first important aspect of the invention to provide a portable and yet self sufficient cargo loading apparatus for dispensing and retrieving cargo between a central hold location of a haulage vessel and the wing areas thereof.

It is a second important aspect of the invention to provide such cargo apparatus that is not only portable and self sufficient but at the same time is capable of handling significantly greater loading capacities for dispensing cargo into the wing areas of the hold than has been available heretofore.

It is a third important aspect of the invention to provide cargo handling apparatus as in the second aspect hereof capable of incremental lateral self displacement within the hold for dispensing cargo loads successively into juxtaposed wing sites of a cargo ship.

The above noted features and advantages of the invention as well as other superior aspects thereof will be further appreciated by those skilled in the art upon reading the detailed description which follows in conjunction with the drawings.

DESCRIPTION OF THE PREFERRED EMBODIMENT

Figures 1, 2:
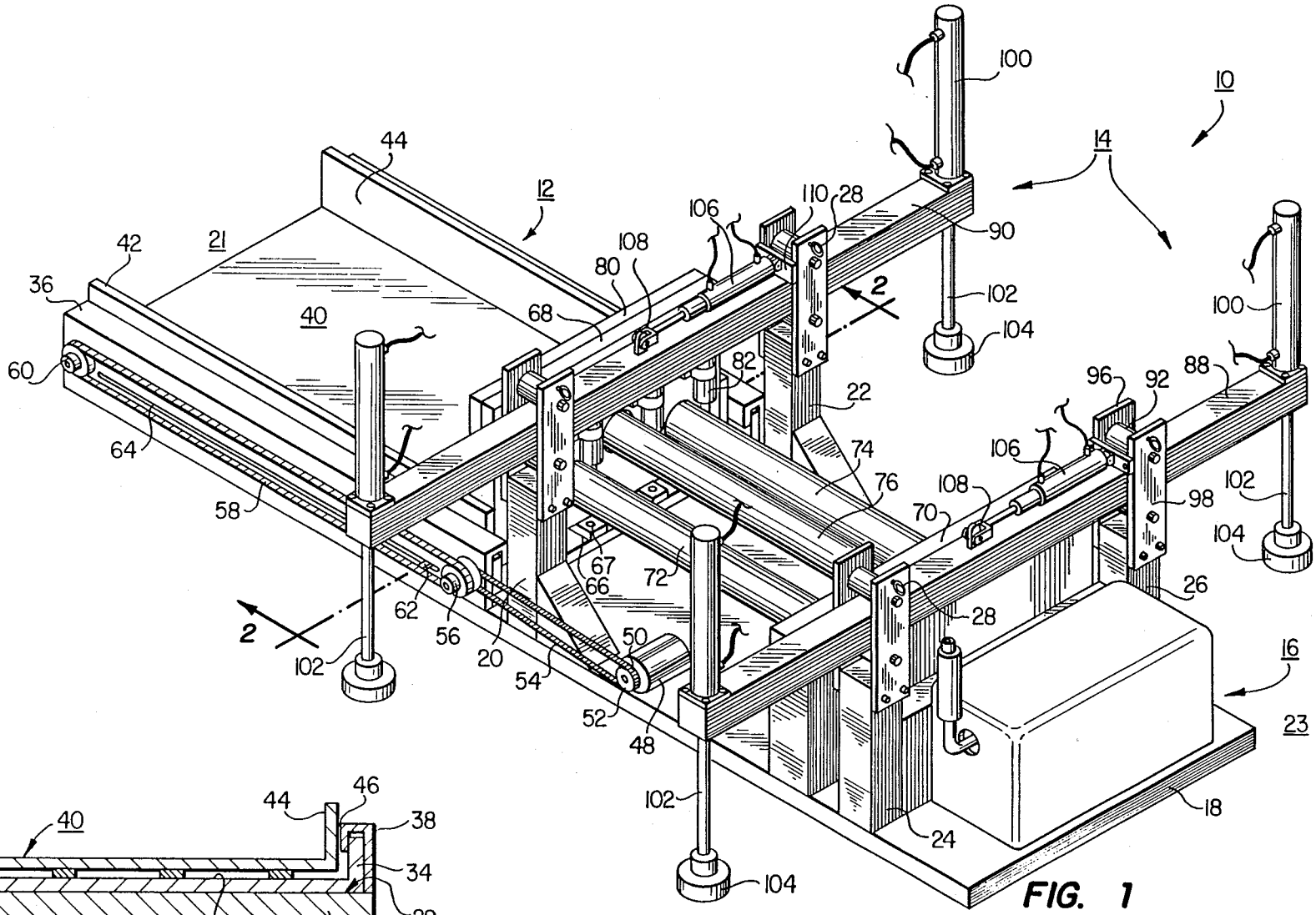
FIG. 1 is topside isometric view of the cargo loading apparatus hereof.
FIG. 2 is a sectional view as seen substantially from the position 2—2 of FIG. 1.

In the description which follows, like parts are marked throughout the specification and drawings with the same reference numerals respectively. The drawing figures are not necessarily to scale and certain views may be drawn rotated into the plane of the drawing for purposes of clarity.

Referring now to the drawings, the apparatus hereof is designated 10 and is comprised of a first section 12 to effect cargo loading and onloading within the wing areas 15 in hold 17 of a ship 19. A second section 14 provides for lateral incremental displacement of the first section to successive cargo loading sites. A third section 16 is joined with the other sections and contains a power source such as a diesel generator, pumps and the various controls necessary to render the apparatus self sufficient for effecting operation hereof as will be described.

Providing the underlying support for the operative components hereof is an elongated rectangular base 18 extending from the forward end 21 to the rearward end 23 underlying power section 16. Upstanding from base 18 at the sides and at a relatively rearward location are four columns 20, 22, 24 and 26. Each column includes an I-hook 28 by which the entire apparatus 10 can be transferred from deckside or dockside through cargo hatch 23 to within hold 17 by means of a deck or dockside crane as would be available. For balancing purposes, additional columns (not shown) and I-hooks (not shown) may be provided in the vicinity of power section 16.

Comprising the first section 12 at the relatively forward end of base 18 are opposite upright elongated side channels 36 and 38 forming with base 18 a lowermost and stationary U-shaped tray 29. Slidably received within tray 29 is a middle U-shaped tray 30 having opposite side uprights 32 and 34 slidably contained for longitudinal displacement within channels 36 and 38. Overlying tray 30 and slidably supported and nested thereon is a U-shaped upper tray 40 that includes longitudinal side uprights 42 and 44. The overall width of tray 40 provides a clearance space 46 on either side relative to the side face of channels 36 and 38 thereat. When retracted, as illustrated in FIG. 1, each of the trays 29, 30 and 40 are in a nested relation with the latter two capably of being selectively and controllably extended as will be described. For accommodating the load capacities contemplated with the apparatus hereof, each of the trays 29, 30 and 40 are approximately 16 feet long and 9 feet wide able, for example, to receive approximately 4–6 pallet loads per loading cycle. In order to render the trays relatively slidable to each other, they are formed of stainless steel or other composition of similar strength and low friction properties at least along their slidable surfaces.

Figure 7:
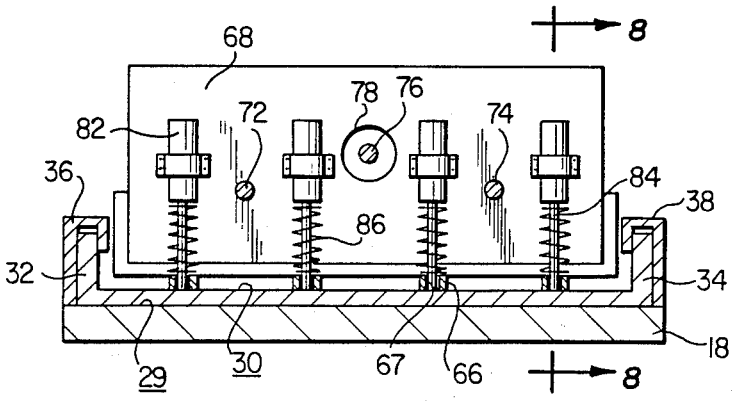
FIG. 7 is an enlarged sectional elevation as taken substantially from the position 7—7 of FIG. 5.
Figure 8:
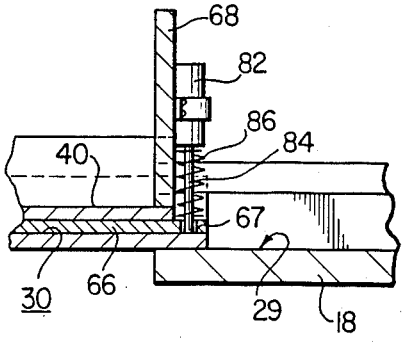
FIG. 8 is a fragmentary sectional elevation as seen substantially from the position 8—8 of FIG. 7.

When the apparatus 10 is transferred by crane or the like from dockside or deckside through cargo hatch 23, both trays 30 and 40 are contained in their retracted relations as illustrated in FIG. 1. To extend tray 30 leftward as viewed in FIG. 1, there is provided an hydraulic motor 48 mounted on base 18 and which through a clutch 50 and a chain sprocket 52 drives chain 54. Chain 54, in turn, through idler sprocket 56 drives chain 58 extending about idler sprocket 60. A bolt 62 laterally secured to the upright 32 of tray 30 extends through longitudinal slot 64 in channel 36 and is secured to the underside of chain 58. When driven, chain 58 causes bolt 62 to incur concomitant forward movement therewith for effecting outward displacement of tray 30. Clutch 50 for these purposes, has one-way operation being a type having a helically wound spring as manufactured by Warner Electric Brake and Clutch Co. of South Beloit, Ill. Secured longitudinally along the upper surface of tray 30 are a plurality of spaced apart and parallel ribs 66 (FIG. 7). The ribs in this relation are longitudinally intervening between the trays so as to provide the relatively slidable surface therefor. Also, each of the ribs includes a plurality of longitudinally extending uniformly spaced vertical apertures 67 at least near the rearward end thereof to enable a coupled retraction of the trays 30 and 40 as will be explained.

Extending transversely upright and joined between side uprights 42 and 44 so as to define the rear of top tray 40 is a rear wall 68. Horizontally extending longitudinally rearward from a connection with wall 68 for mounting on a stationary wall 70 are two spaced hydraulic cylinders 72 and 74. As shown in FIG. 1, the hydraulic cylinders are in their retracted positions and when hydraulically actuated, the pistons thereof are operatively extended to displace tray 40 toward its extended position beyond front end 21. A hydraulic cylinder 76 located intermediate cylinders 72 and 74 is likewise mounted on wall 70 and extends through aperture 78 in rear wall 68 for engaging push bar 80. The push bar is dimensionally comparable with wall 68 and can be advanced and retracted in tray 40 independent of tray displacement. On the back side of wall 68 (FIG. 7) are a plurality of spaced apart vertically oriented hydraulic cylinders 82 each having a downwardly depending actuating pin 84 spring loaded upwardly by means of spring 86. Each cylinder 82 when actuated will cause pin 84 to extend downwardly for a latching engagement and interlock cooperation with one of the apertures 67 in ribs 66 in order to couple the trays and enable concomitant retraction of trays 30 and 40 as will be understood. During retraction, one way clutch 50 will free wheel. After a selected wing site has been completely loaded and it is desired to load the adjacent site, the entire loading section 12 is retracted into the relation of FIG. 1.

To effect lateral relocation of the apparatus, second section 14 includes a pair of parallel spaced apart elongated beams 88 and 90 supported for relative transverse displacement on column members 20, 22, 24 and 26. The length of the beams is preferably slightly greater than twice the overall width of the base 18 with a strength factor readily able to accommodate the entire static and dynamic weight of the unit 10. Supporting the beams 88 and 90 at each of the columns for displacement relative to the other structures hereof is a pair of vertically spaced guide rollers 92 and 94 framed and journaled for rotation between upstanding parallel plates 96 and 98 secured in turn to the respective columns.

At the distal end of each of the beams there is disposed a vertically oriented hydraulic power cylinder 100 the piston 102 of which extends downwardly depending for supporting at its distal end a round circular pad 104. Secured longitudinally and arranged on the top surface of each of the beams is a hydraulic cylinder 106 extending between a clevis connection 108 and a cross plate 110 mounted in turn against upright plates 96 and 98. It will be appreciated that extending and retracting the hydraulic cylinders 106 will cause beams 88 and 90 to be displaced in opposite directions relative to the main frame as will be explained.

Figure 3:
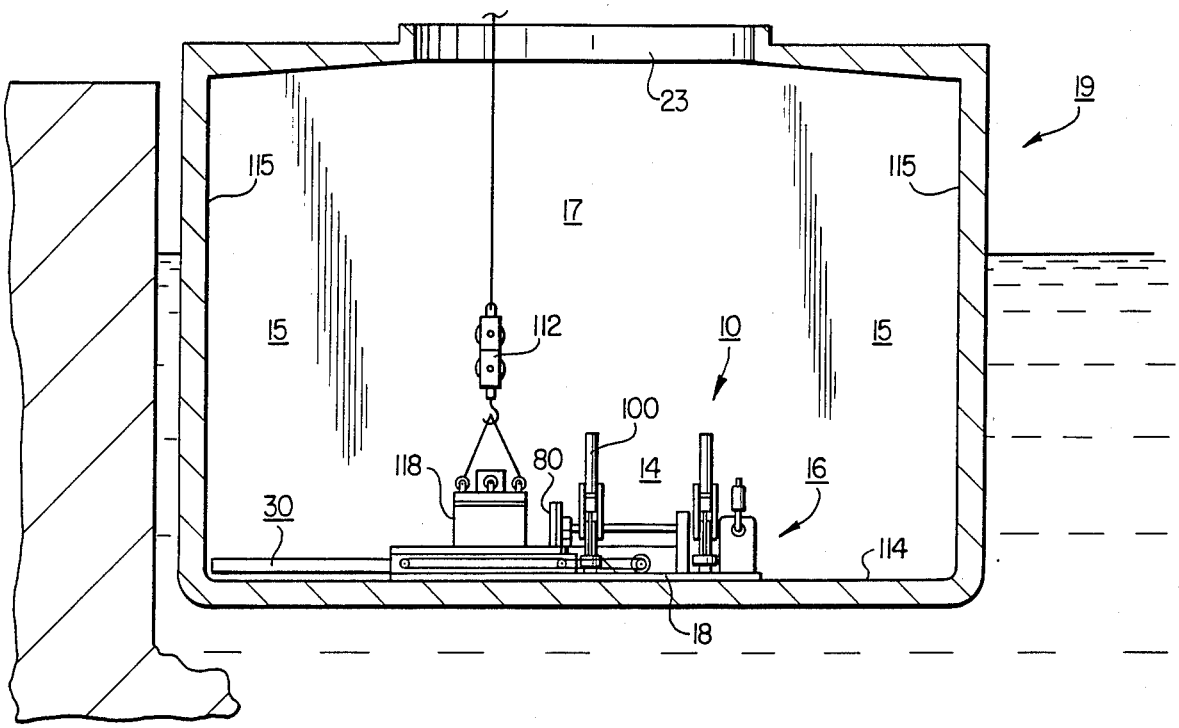
FIG. 3 is a sectional view through a cargo vessel showing the apparatus hereto receiving delivery of cargo from dockside.
Figure 4:
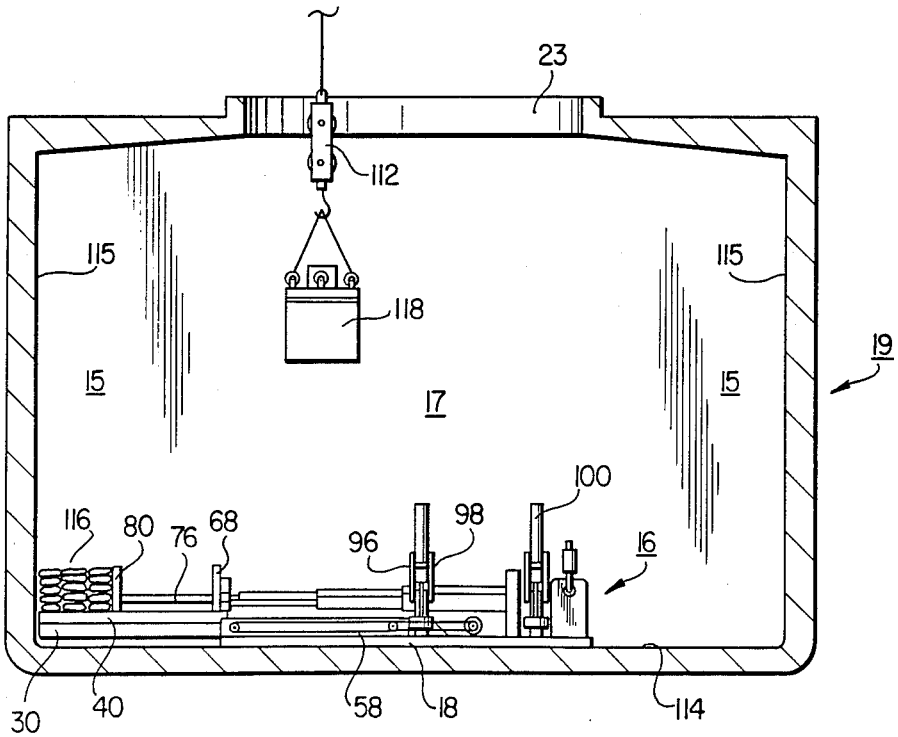
FIG. 4 is a sectional view similar to FIG. 3 in which the delivered cargo of FIG. 3 is being dispensed by the apparatus hereto in its extended relation into a selected site within the wings of the hold.
Figure 5:
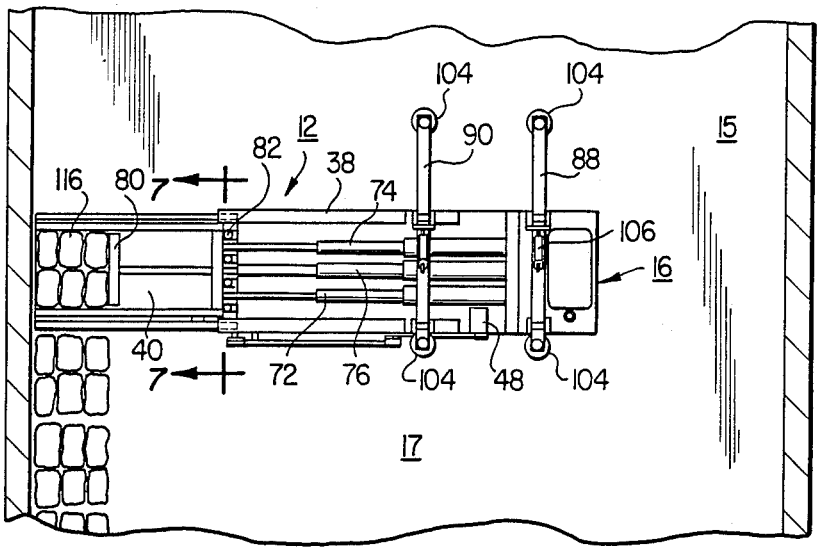
FIG. 5 is a plan view of FIG. 4.
Figure 6:
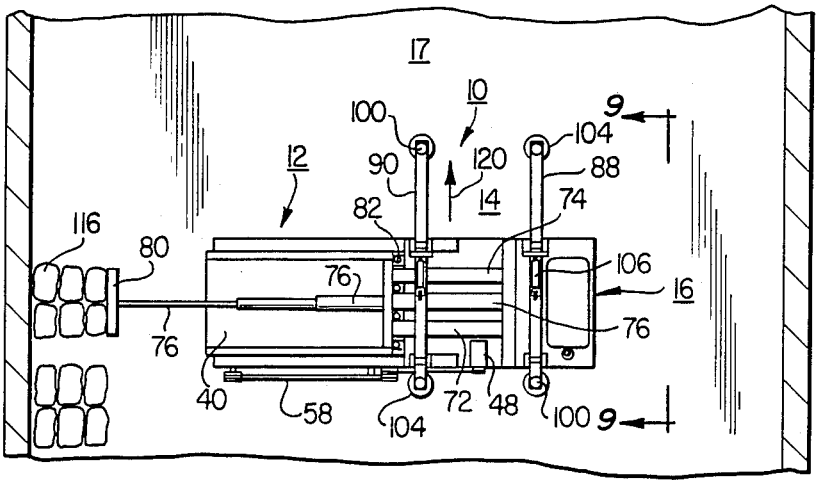
FIG. 6 is a plan view similar to FIG. 5 in the course of the loading section of the apparatus hereto being retracted.
Figure 9:
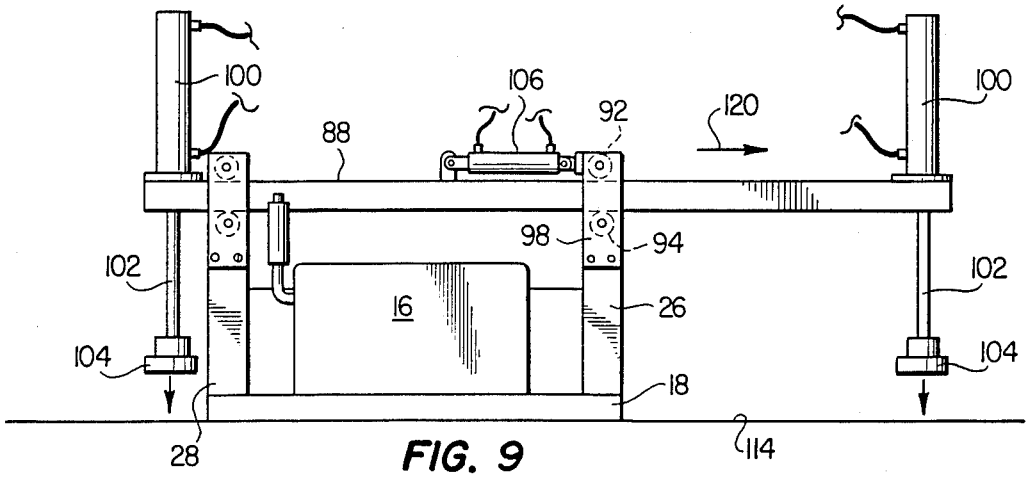
FIGS. 9, 10 and 11 are enlarged sequential rear elevations taken substantially from the position 9—9 of FIG. 6 for the incremental self displacement function of the apparatus hereof.
Figure 10:
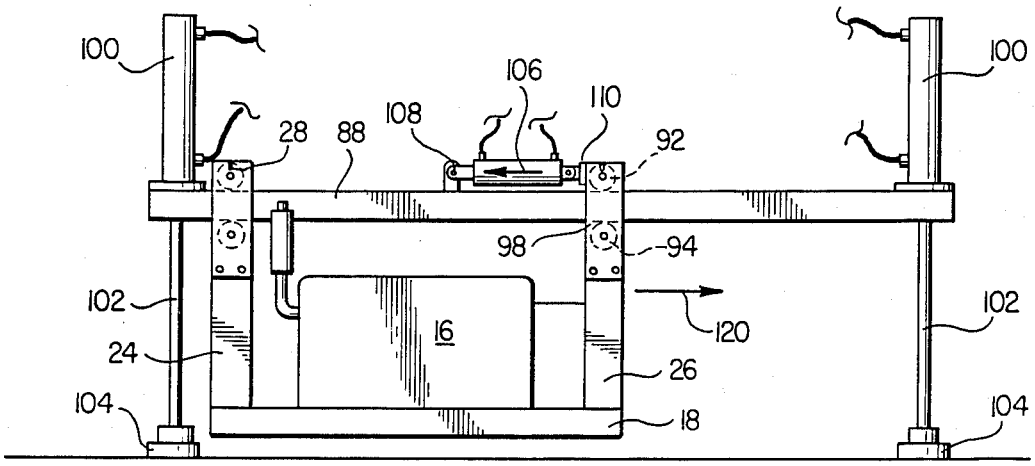

In operation, the entire unit 10 can be lowered through cargo hatch 23 via a crane hook 112 for placement on flooring 114 of hold 17 at a location and in an orientation selected for cargo loading into an opposite and paired location representing a first cargo loading site in wing 15. At this point in time, the support pads 104 are elevated in the relation of FIG. 9 and the underside of base 18 rests on the flooring 114. With unit 10 in position on flooring 114, and all power components in section 16 operative, hydraulic cylinders 100 are simultaneously energized to extend their pistons 102 downwardly until their support pads 104 engage against flooring 114. Continuing to extend pistons 102 causes the main frame of the apparatus to become elevated above flooring 114 until achieving the relation illustrated in FIG. 10. While still elevated hydraulic motor 48 is actuated and through clutch 50 motor 48 causes middle tray 30 to be extended outwardly until approaching the proximity of wing wall 115 as illustrated in FIG. 3. Once tray 30 has been extended, hydraulic cylinders 100 are reversed causing their pistons 102 and pads 104 to be retracted upwardly until the main frame is again supported directly on the flooring 114 in the manner of FIG. 9. With the apparatus on flooring 114 a cargo load 116, which may be transported and handled by apparatus 118, such as disclosed in my U.S. Pat. No. 4,432,689, is lowered via hook 112 through cargo hatch 23 onto top tray 40 as illustrated in FIG. 3. After separating the cargo load 116 from the cargo handler 118, push cylinders 72, 74 and 76 are simultaneously actuated for extending top tray 40 and push bar 80 along with the cargo load 116 thereon until the upper tray 40 is positioned substantially coextensive with and is superimposed over the middle tray 30 as shown in FIG. 4.

With the cargo 116 having reached its destination site in wing 15, the middle and upper trays 30 and 40 are withdrawn concomitantly. This is effected by first coupling the trays via hydraulic cylinders 82 causing their pins 84 to extend into an interlock relation with one of the apertures 67 of ribs 66 extending along the topside of tray 30. On being coupled, the middle tray 30 and upper tray 40 are withdrawn or retracted concomitantly by reversing operation of the push cylinders 72 and 74 so as to retract and withdraw tray 40. During withdrawal of the trays, push bar 80 remains engaged against the cargo 116 until the trays are removed from under the cargo after which push bar 80 is per se retracted by reversing hydraulic cylinder 76. When fully retracted, the trays are uncoupled by reversing cylinders 82 to permit their subsequent relatively independent extension as previously described for dispensing additional cargo load 116.

Figure 11:
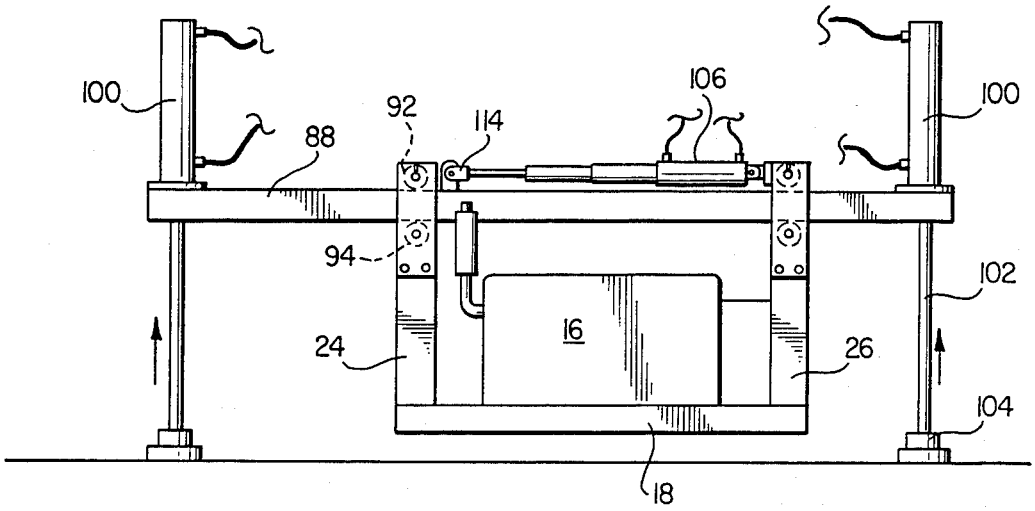

After a first cargo loading has been loaded as described above and with all operating components of section 12 in their retracted starting relation, the main frame of the apparatus is incrementally displaced laterally, in the direction of arrow 120 by means of section 14. The main frame is first elevated by operation of hydraulic cylinders 100 as described above. With the main frame elevated, the hydraulic cylinders 106 are simultaneously energized so as to extend and cause the main frame to be conveyed by means of rollers 92 and 94 over parallel beams 88 and 90 in the direction 120 from left to right as viewed in the comparative illustrations of FIGS. 10 and 11. When the main frame arrives at its laterally displaced location corresponding and oriented to the second cargo loading site in which the next cargo loading is to be placed, tray 30 is extended as aforesaid before the main frame is lowered by reversal of hydraulic cylinders 100. After being lowered, the entire unit 10 is in position for receiving additional cargo 116 to be dispensed into the wing area adjacent to wall 115 and juxtaposed to the load previously placed in the first loading site thereat. During the cargo loading process, hydraulic cylinders 106 are reversed so as to retract and cause the beams 88 and 90 to be restored to the relation with the main frame shown in FIG. 9 in preparation for the next main frame displacement in the direction 120 as aforesaid.

The foregoing is continually repeated over and over until one side of the wing is completely loaded with cargo. At that point, apparatus 10 is positioned via crane hook 112 at right angles to similarly load the ends of the hold. On completion of end loading the apparatus is again turned to similarly load the opposite wing followed by the opposite end. After the entire wings and ends have been loaded, the square of the hold beneath the cargo hatch can, for example, be loaded by means of apparatus disclosed in my U.S. Pat. 4,432,689. On completion of one layer of loaded cargo throughout the hold 15, apparatus 10 is placed on top of the cargo and the operation is repeated as in the preceding. For unloading, the operation is similar except for retrieval of cargo from the wing site onto tray 40 which is then retracted to the square of the hold.

By the above description there is disclosed novel apparatus for cargo loading and unloading wing areas of cargo ships. The apparatus hereof can increase loading capability from about 40 tons per hour in accordance with past practices to in excess of 100 tons per hour. At the same time it represents a significant advance in the art in being able to handle not only greater load capacities but is operative with substantial reduction in labor force as compared to the loading apparatus previously utilized for the cargo loading of wing areas. Except for personel utilized in the delivery of the cargo onto tray 40, only one person is required to operate the apparatus per se. During loading, the remaining persons are then free to perform other chores in and about the hold. The economic savings resulting from the reduced time and labor associated with the enhanced loading efficiency afforded by the apparatus hereof is so significant as to contribute substantial cost savings in the overall loading of such ships destined for the many parts of the world. In some instances charges for ocean freight is based on a flat rate per container rather than weight of goods being shipped, such that any reduction in labor and time involvement can result in substantial monetary savings to the shipper. Consequently, the virtues of the apparatus hereof should be instantly apparent. While use of a power generator has been described as included with the preferred embodiment, it obviously can be eliminated on those models intended for applications where adequate sources of local power is otherwise available. Furthermore, whereas the apparatus has been described as principally useful in the dispensing of cargo into the wing areas of the hold, it should be apparent that it is similarly useful for retrieving cargo therefrom in the unloading process from the wing areas.

Since many changes could be made in the above construction and many apparently widely different embodiments of this invention could be made without departing from the scope thereof, it is intended that all matter contained in the drawings and specification shall be interpreted as illustrative and not in a limiting sense.

I claim:

1. Apparatus for relatively relocating cargo between paired locations within a haulage vehicle, said apparatus being portable for placement in and removal from the haulage vehicle in which it is to be utilized and comprising:

a plurality of relatively displaceable, interfitting and elongated trays including:

an uppermost tray adapted to receive cargo at one of said paired locations and being horizontally movable between an extended position and a retracted position, and an underlying tray positioned lower than said uppermost tray and being horizontally movable between an extended position in which said underlying tray is positioned beneath and supports said uppermost tray in its extended position, and a retracted position in which said underlying tray is positioned beneath and supports said uppermost tray in its retracted position;

first operating means for controllably extending and retracting said uppermost tray and said underlying tray to relocate cargo received by said uppermost tray at said one of said paired locations toward the other of said paired locations to which the received cargo is to be relocated, said first operating means being operative to extend said underlying tray in a controlled timed relation to the extension of said uppermost tray and to extend said underlying tray before said uppermost tray is extended, whereby said underlying tray, when extended, provides support for said uppermost tray during the course of said uppermost tray being extended and retracted;

coupling means for coupling said uppermost tray and said underlying tray, when in their extended positions, to enable their concomitant retraction by said first operating means, said first operating means including first drive means for extending one of said uppermost tray and said underlying tray, and second drive means for extending the other of said uppermost tray and said underlying tray, and for concomitantly retracting said trays when the same are coupled by said coupling means; and second operating means, controllably operative when said uppermost tray and said underlying tray are substantially in their retracted positions, for laterally displacing said trays to other paired locations at which received cargo is to be relocated.

2. The apparatus of claim 1 further comprising:

self contained power generator means for supplying operative power to at least one of said first and second operating means.

3. The apparatus of claim 1 further comprising:

third operating means for pushing cargo off said uppermost tray in response to retraction thereof from its extended position.

4. The apparatus of claim 1 further comprising:

a stationary tray interfitting with and movably supporting said underlying tray in its retracted position.

5. Apparatus for relocating cargo from a delivery location within the hold of a cargo ship to a wing location therein, said apparatus comprising:

a plurality of relatively displaceable, interfitting and elongated trays including:

an uppermost tray adapted to receive cargo at said delivery location and being horizontally movable between an extended position and a retracted position, and an underlying tray positioned lower than said uppermost tray and being horizontally movable between an extended position in which said underlying tray is positioned beneath and supports said uppermost tray in its extended position, and a retracted position in which said underlying tray is positioned beneath and supports said uppermost tray in its retracted position;

first operating means for controllably extending an retracting said uppermost tray and said underlying tray to relocate cargo received by said uppermost tray at said delivery location toward said wing location; and second operating means, controllably operative when said uppermost tray and said underlying tray are substantially in their retracted positions, for laterally displacing said uppermost tray and said underlying tray to another location within the hold to enable relocation of cargo to another wing location therein, said second operating means including elevating means operative when actuated to elevate said uppermost tray and said underlying tray clear of the support plane of said ship hold, elongated support means for supporting the elevated uppermost and underlying trays, and drive means operative to laterally displace the elevated uppermost and underlying trays on said support means from one location in said hold to another location therein, said support means comprising a plurality of spaced apart parallel beams secured to said trays and extending in a direction transverse to the direction of tray extension effected by said first operating means, said drive means operatively engaging at least one of said beams, said beams having a length at least twice the width of said trays, said elevating means being operative after said trays have been laterally displaced by said drive means to lower said trays onto the support plane of said hold, and said drive means being operable when said trays are supported on said support plane to displace said beams transversely relative to said trays.

6. The appartus of claim 5 further comprising:

third operating means for pushing cargo off said uppermost tray in response to retraction thereof from its extended position.

7. The apparatus of claim 5 further comprising:

self contained power generator means for supplying operative power to at least one of said first and second operating means.

8. The apparatus of claim 5 further comprising:

a stationary tray interfitting with and movably supporting said underlying tray in its retracted position.

9. The apparatus of claim 5 wherein:

said hold has a hatch opening in an upper portion thereof, and said apparatus is sized to be lowered into said hold through said hatch opening and onto the support plane of said hold.

10. The apparatus of claim 5 further comprising:

coupling means for coupling said uppermost tray and said underlying tray in their extended positions in a manner enabling one of said trays to be pulled to its retracted position by the other of said trays when said other of said trays is moved to its retracted position by said first operating means.

11. Material handling apparatus, movably supportable on a horizontal surface, for receiving an object at a first receiving location and horizontally relocating the received object to a first storage location spaced apart from said first receiving location, said material handling apparatus comprising:

a base structure movably supportable on said horizontal surface generally at said first receiving location;

a first support member carried by said base structure for horizontal movement relative thereto between an inwardly retracted position and an outwardly extended position, said first support member, when in its retracted position, being adapted to receive and support the object, and having a horizontally outer portion positionable over said first storage location in response to movement of said first support member to its extended position;

a second support member positioned lower than said first support member and carried by said base structure for horizontal movement relative thereto, and relative to said first support member, between an inwardly retracted position in which said second support member underlies and supports said first support member in its retracted position, and an outwardly extended position in which said second support member underlies and supports said first support member in its extended position;

coupling means for coupling said first and second support members in their extended positions in a manner such that movement of one of said first and second support members to its retracted position causes the retraction of the other of said first and second support members to its retracted position;

pusher means, carried by said base structure above said first and second support members, for pushing the received object outwardly off said first support member, said pusher means being horizontally movable relative to said base structure between an inwardly retracted position in which said pusher means are positioned horizontally inwardly of the received object, and an outwardly extended position; and operating means for sequentially:

(1) moving said second support member from its retracted position to its extended position, (2) moving said first support member, with the received object supported thereon, from its retracted position to its extended position, (3) moving said pusher means from their retracted position to their extended position to push the received object outwardly along said first support member to said horizontally outer portion thereof, (4) retracting one of said first and second support members to thereby simultaneously retract the other of said first and second support members via the operation of said coupling means, and to cause said pusher means in their extended position to engage and inwardly stop the received object so that when said horizontally outer portion is withdrawn from beneath the received object the object drops to said first storage location, and (5) moving said pusher means from their extended position to their retracted position to ready said material handling apparatus for a subsequent object receiving and relocation cycle.

12. The material handling apparatus of claim 11 wherein:

said first and second support members are interfitted and relatively movable first and second tray members.

13. The material handling apparatus of claim 12 further comprising:

a stationary tray member carried by said base structure, said second tray member being interfitted with and movable relative to said stationary tray member.

14. The material handling apparatus of claim 11 further comprising:

relocation means associated with said base structure and operative to selectively reposition it to a second receiving location spaced apart from said first receiving location to ready said material handling apparatus for receiving a second object and horizontally relocating the received second object to a second storage location.

15. The material handling apparatus of claim 14 wherein said relocation means include:

a support frame structure connected to said base structure for movement relative thereto in a direction generally transverse to the extension directions of said first and second support members and having a lower portion selectively extendable and retractable into and out of engagement with said horizontal surface to respectively elevate said base structure relative to said horizontal surface and lower said base structure onto said horizontal surface, and drive means for sequentially:

(1) extending said lower portion of said support frame structure into engagement with said horizontal surface in a manner lifting said base structure upwardly from said horizontal surface, (2) moving the lifted base structure relative to the support frame structure in a direction generally transverse to the extension directions of said first and second support members, (3) retracting said lower portion of said support frame structure in a manner lowering the lifted base structure onto said horizontal surface and elevating said lower portion of said support frame structure relative to said horizontal surface, and (4) moving said support frame structure relative to the lowered base structure in a direction generally transverse to the extension directions of said first and second support members.

* * * * *